US006874202B2

(12) United States Patent
Pferdmenges et al.

(10) Patent No.: US 6,874,202 B2
(45) Date of Patent: Apr. 5, 2005

(54) CYLINDER FOR SPINNING PREPARATION MACHINE

(75) Inventors: Gerd Pferdmenges, Jüchen (DE); Robert Pischel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 154 days.

(21) Appl. No.: 10/294,697

(22) Filed: Nov. 15, 2002

(65) Prior Publication Data

US 2003/0110594 A1 Jun. 19, 2003

(30) Foreign Application Priority Data

Dec. 19, 2001 (DE) ..... 101 62 313

(51) Int. Cl.[7] ..... D01G 15/12
(52) U.S. Cl. ..... 19/112; 19/98; 19/106 R
(58) Field of Search ..... 19/98, 99, 100, 19/105, 106 R, 107, 112, 65 R, 200, 202, 203, 204, 205, 115 R, 215, 128; 492/47; 29/895.22

(56) References Cited

U.S. PATENT DOCUMENTS

| | | | | | |
|---|---|---|---|---|---|
| 60,792 | A | * | 1/1867 | Russell et al. | 492/47 |
| 119,504 | A | * | 10/1871 | Brooks | 474/166 |
| 142,364 | A | * | 9/1873 | Amsden | 464/184 |
| 243,897 | A | * | 7/1881 | Hill | 474/187 |
| 1,092,464 | A | * | 4/1914 | Watson et al. | 384/565 |
| 2,429,293 | A | * | 10/1947 | Peck et al. | 29/895.22 |
| 3,971,115 | A | * | 7/1976 | Schneider et al. | 29/895.32 |
| 4,062,098 | A | * | 12/1977 | Brugman | 226/191 |
| 4,771,874 | A | * | 9/1988 | Leigh-Monstevens | 192/98 |
| 5,229,813 | A | * | 7/1993 | Cherian | 399/164 |
| 5,893,210 | A | * | 4/1999 | Takei et al. | 29/895.32 |
| 6,293,894 | B2 | * | 9/2001 | Viaud et al. | 492/47 |
| 6,676,582 | B1 | * | 1/2004 | Thompson | 492/47 |

FOREIGN PATENT DOCUMENTS

| | | |
|---|---|---|
| DE | 1 037 332 | 8/1958 |
| DE | 66 04 100 | 9/1969 |
| DE | 35 31 850 A1 | 3/1987 |
| DE | 37 40 908 C2 | 6/1989 |
| DE | 40 18 339 A1 | 12/1991 |
| DE | 41 19 359 C2 | 9/1992 |

OTHER PUBLICATIONS

Taschenbuch Maschinenbau, Bd. 3, Verlag Technik Berlin, 1987, S. 109, 110; S. 109, 110, 1.4 Wellen und Achsen.

* cited by examiner

*Primary Examiner*—Gary L. Welch
(74) *Attorney, Agent, or Firm*—Venable LLP

(57) ABSTRACT

A cylinder is provided for a spinning preparation machine. The cylinder has an outer shell having a hub at each end of the outer shell. A separate shaft journal is connected to each hub and the shaft journals are glued to the hubs.

13 Claims, 2 Drawing Sheets

CYLINDER FOR SPINNING PREPARATION MACHINE

CROSS-REFERENCE TO RELATED APPLICATION

This application claims priority to German Patent Application No. 101 62 313.5, filed Dec. 19, 2001, the disclosure of which is incorporated herein by reference.

BACKGROUND OF THE INVENTION

The invention relates to a cylinder for a spinning preparation machine, for example a main carding cylinder, a doffer or the like on a carding machine. More particularly, the invention relates to such a cylinder where the outer shell of the cylinder at its ends rests against a hub mounted on a drive shaft.

A known cylinder for a carding machine is shown in German Unexamined Published Application 35 31 850 and is provided with a continuous shaft which transfers torque by means of tensioning elements. The cylinder is accommodated by hubs that are attached to outer steel plates and is connected with tensioning elements to the drive shaft. The tensioning elements can be annular springs, for example. Once the shaft is mounted, shaft journals and the outer shell are rotated during one operating cycle to create a trouble-free rotational movement. However, the known arrangement has the disadvantage that the tensioning elements create undesirable bending stresses in the projecting shaft journals, making a later, expensive reworking unavoidable. In addition, the continuous shaft results in considerable weight for the cylinder.

SUMMARY OF THE INVENTION

It is an object of the invention to create a cylinder of the above-described type that avoids the aforementioned disadvantages and, in particular, makes it easy to achieve a smaller deviation in the true running tolerance and lowers the weight considerably.

The above and other objects are achieved according to the invention by the provision of a cylinder for a spinning preparation machine. The cylinder has an outer shell having a hub at each end of the outer shell. A separate shaft journal is connected to each hub and the shaft journals are glued to the hubs.

In the invention, undesirable bending stresses are avoided because only two short shaft journals are used (for example, glued in place). In this example, axial and radial fastening is achieved with a glued connection that determines the torque and the bending moments. The weight of the cylinder is reduced considerably by using only two short shaft journals, so that shorter acceleration times and deceleration times and lower drive capacities are possible.

Another production/technological advantage is that completely finished shaft journals are glued in place. As a result, the cylinder bearing and the housing can be pre-mounted on the shaft journal before it is glued in place, thus simplifying and accelerating the assembly.

The glued connection is preferably created with an anaerobic hardening single-component adhesive, and is exclusively a glued connection with no play following hardening of the glue. As a result, no stresses are created in the components following the joining operation. In addition, this set up results in a more true running cylinder as compared to those with long operating journals. True running deviations of less than 0.15 can be achieved with glued-in shaft journals.

According to another aspect of the invention, there is provided a method of assembling a cylinder for a spinning preparation machine, the cylinder having an outer shell with a hub at each end of the outer shell. The method includes steps of first attaching cylinder bearings to the spinning preparation machine, then attaching a shaft journal to each of the cylinder bearings, and then gluing each shaft journal to a respective one of the hubs.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
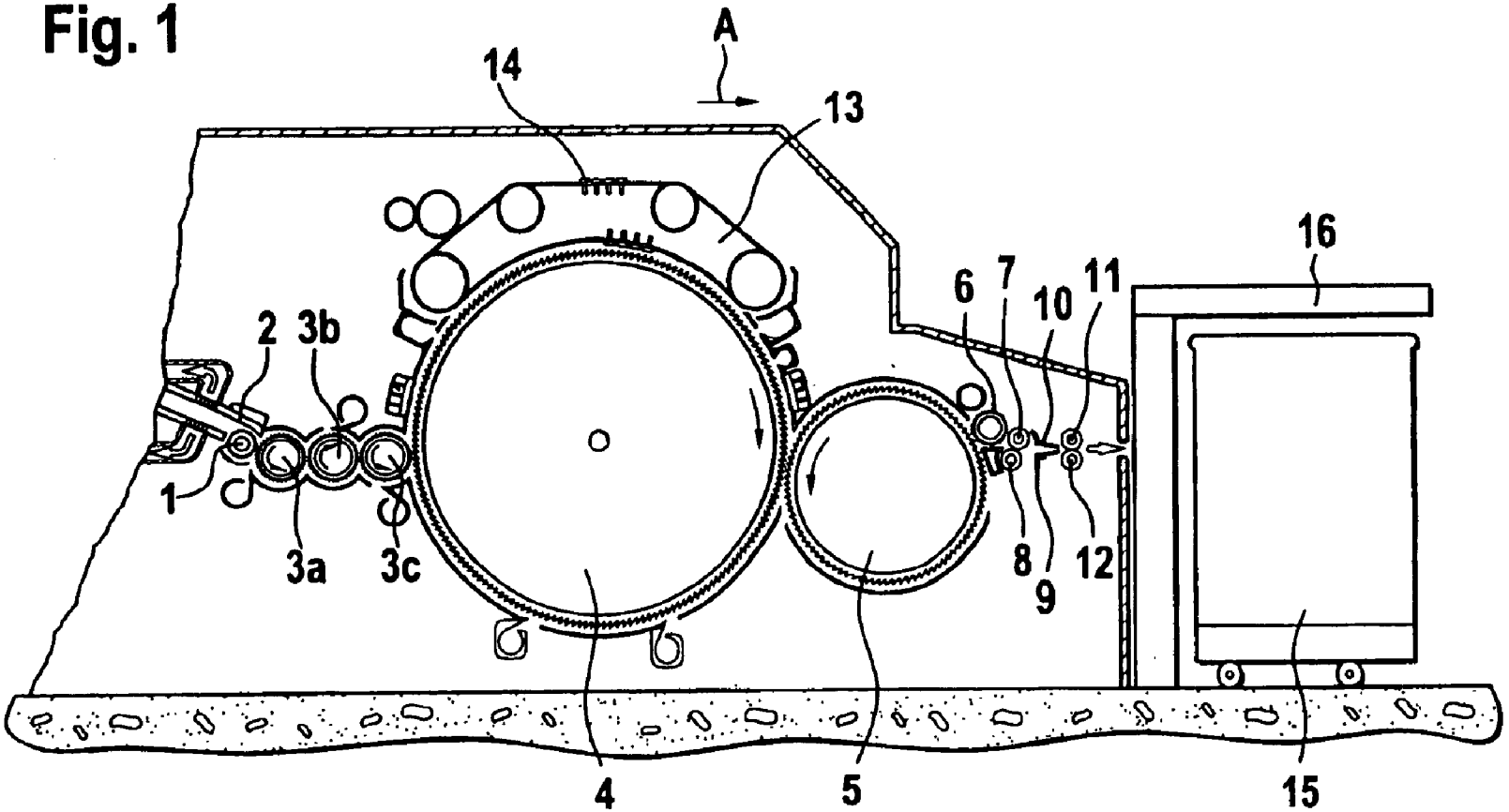
FIG. 1 is a side elevation schematic view of a carding machine with a main carding cylinder according to the invention.

FIG. 1 shows a carding machine, for example a high-performance card DK 903 by the company Trützschler in Mönchengladbach, Germany. The carding machine has a feed roll 1, a feed table 2, licker-ins 3*a,* 3*b,* 3*c,* a main carding cylinder 4, a doffer 5, a stripping roll 6, crushing rolls 7, 8, a sliver guide element 9, a web trumpet 10, withdrawing rolls 11, 12, traveling flats 13 with clothed flat bars 14, a can 15 and a can holder 16. Curved arrows indicate the rotational directions of the rolls while the arrow A indicates the operating direction.

Figure 2:
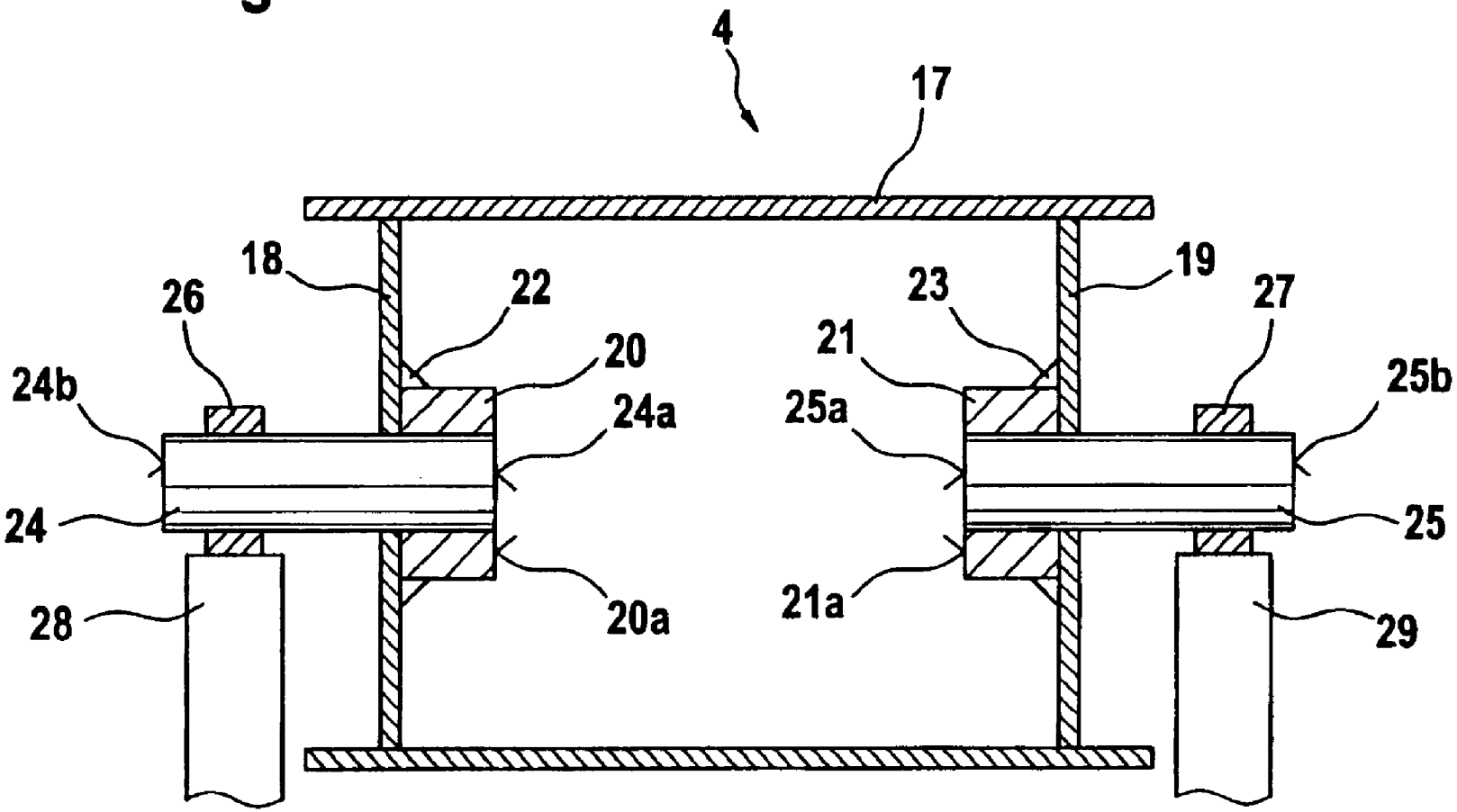
FIG. 2 is a cross section through the main carding cylinder according to the invention, comprising two short shaft journals.

The exemplary main carding cylinder 4, shown in FIG. 2, has an outer shell 17 made of, for example, sheet steel. The outer shell 17 is respectively supported at both ends with cylinder bottoms 18 and 19 on essentially hollow-cylindrical hubs 20, 21. The hubs 20, 21 are preferably welded to the cylinder bottoms 18, 19 with welded connections 22, 23. The hub 20 is glued to a short cylindrical shaft journal 24 such that it can rotate and the hub 21 is glued to an additional short cylindrical shaft journal 25 such that it can rotate. The internal front faces 24*a,* 25*a* of shaft journals 24, 25 essentially end with the internal front face 20*a* or 21*a* of hubs 20, 21. The outer front faces 24*b,* 25*b* extend past the side surfaces of the cylinder 4 toward the outside. The outer ends of the shaft journals 24, 25 are positioned in locally fixed bearings 26 and/or 27 that are attached to machine walls 28, 29. The main carding cylinder 4 has a circumferential speed of, for example, 40 m/sec.

In contrast to known cylinders, which are provided with a single continuous drive shaft, the invention provides two short shaft journals 24, 25 that are, in this example, glued in place. The glued connection supports the torque, the axial fastening and the bending moments, resulting in a clear weight reduction for the cylinder 4. The glued connection is characterized in that a completely finished cylinder journal 24, 25 is glued in place. The cylinder bearings 26, 27 and the housing (machine walls 28, 29) can thus be pre-assembled before the respective journals 24, 25 are glued in place.

The glued connection preferably is created with an anaerobic hardening single-component adhesive. Since, in this example, the connection is exclusively a glued connection, it has essentially no play following the hardening process. As a result, no material stresses are created in these components through the joining method. In addition, the invention results in a more true running cylinder as compared to those with long drive journals. Traditionally produced cylinders 4 have a deviation of 0.2 to 0.3 for the long drive journal, whereas the glued journals according to the invention have true running deviations of less than 0.15.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A cylinder for a spinning preparation machine, the cylinder comprising:

an outer shell having a hub at each end of the outer shell;

a separate shaft journal connected to each hub, wherein the shaft journals are completely finished then glued to the hubs; and cylinder bearings attached to the finished shaft journals.

2. The cylinder according to claim 1, wherein the shaft journals do not contact each other.

3. The cylinder of claim 2, wherein an inside end of each shaft journal is substantially flush with an inside end of its respective hub.

4. The cylinder according to claim 1, wherein an outer surface of each shaft journal is glued to an inner surface of its respective hub.

5. The cylinder according to claim 1, wherein the finished shaft journals are glued to the hubs and have cylinder bearings attached thereto, the cylinder bearings further being attached to the spinning preparation machine.

6. The cylinder according to claim 1, wherein the shaft journals are glued with an anaerobic hardening single-component adhesive.

7. The cylinder according to claim 1, wherein the spinning preparation machine is a carding machine and the cylinder is a main carding cylinder.

8. The cylinder according to claim 1, wherein the spinning preparation machine is a carding machine and the cylinder is a doffer.

9. A method of assembling a cylinder for a spinning preparation machine, the cylinder having an outer shell with a hub at each end of the outer shell, the method comprising:

first attaching cylinder bearings to the spinning preparation machine;

then attaching a shaft journal to each of the cylinder bearings; and then gluing each shaft journal to a respective one of the hubs.

10. The method according to claim 9, wherein the shaft journals are glued to the hubs such that the shaft journals do not contact each other.

11. The method according to claim 9, wherein an outer surface of each shaft journal is glued to an inner surface of its respective hub.

12. The method according to claim 9, wherein the shaft journals are glued with an anaerobic hardening single-component adhesive.

13. The method according to claim 9, wherein the spinning preparation machine is a carding machine and the cylinder is a main carding cylinder.

* * * * *